US009297225B2

(12) United States Patent
Nesheim et al.

(10) Patent No.: US 9,297,225 B2
(45) Date of Patent: Mar. 29, 2016

(54) APPARATUS AND METHOD FOR SEPARATING AND WEIGHING CUTTINGS RECEIVED FROM A WELLBORE WHILE DRILLING

(71) Applicants: Anders K. Nesheim, Bru (NO); Kjetil Rosdal, Hafrsfjord (NO); Tarald T. Pedersen, Hundvag (NO); Steve T. Pedersen, Oslo (NO)

(72) Inventors: Anders K. Nesheim, Bru (NO); Kjetil Rosdal, Hafrsfjord (NO); Tarald T. Pedersen, Hundvag (NO); Steve T. Pedersen, Oslo (NO)

( * ) Notice: Subject to any disclaimer, the term of this patent is extended or adjusted under 35 U.S.C. 154(b) by 265 days.

(21) Appl. No.: 13/774,786

(22) Filed: Feb. 22, 2013

(65) Prior Publication Data

US 2014/0238744 A1 Aug. 28, 2014

(51) Int. Cl.
*E21B 21/01* (2006.01)
*E21B 49/00* (2006.01)

(52) U.S. Cl.
CPC ..... *E21B 21/01* (2013.01); *E21B 49/005* (2013.01)

(58) Field of Classification Search
CPC ..... E21B 21/01; E21B 21/065; G01G 11/08; G01G 11/12
See application file for complete search history.

(56) References Cited

U.S. PATENT DOCUMENTS

| | | | | |
|---|---|---|---|---|
| 2,993,625 | A * | 7/1961 | Esval | 222/55 |
| 5,074,435 | A * | 12/1991 | Suverkrop et al. | 222/55 |
| 6,386,026 | B1 | 5/2002 | Zamfes | |
| 6,410,862 | B1 | 6/2002 | Lecann | |
| 6,640,912 | B2 | 11/2003 | Reddoch | |
| 7,642,474 | B2 | 1/2010 | Calleri | |
| 7,971,657 | B2 | 7/2011 | Hollier et al. | |
| 2002/0074269 | A1 * | 6/2002 | Hensley et al. | 209/726 |
| 2008/0196942 | A1 * | 8/2008 | Bingham et al. | 175/46 |
| 2008/0250853 | A1 * | 10/2008 | Calleri | 73/152.19 |
| 2010/0059291 | A1 * | 3/2010 | Lowe et al. | 177/52 |
| 2011/0266065 | A1 | 11/2011 | Calleri | |
| 2013/0323005 | A1 * | 12/2013 | Rexius et al. | 414/803 |
| 2014/0238744 | A1 * | 8/2014 | Nesheim et al. | 175/46 |

FOREIGN PATENT DOCUMENTS

| | | | |
|---|---|---|---|
| DE | 19536871 | A1 | 4/1997 |
| DE | 19829036 | A1 | 1/2000 |
| WO | 0120121 | A1 | 3/2001 |

OTHER PUBLICATIONS

PCT International Search and Written Opinion; International Application No. PCT/US2014/017301; International Filing Date: Feb. 20, 2014; Date of Mailing: Jun. 3, 2014; pp. 1-15.

GEOLOG Surface Logging; "Cutting Volume & Flow Monitoring," http:/www.geologinternational.com/contenido/11/cutting-weight-system/20, Aug. 30, 2013, pp. 1-3.

* cited by examiner

*Primary Examiner* — Jennifer H Gay
(74) *Attorney, Agent, or Firm* — Cantor Colburn LLP

(57) ABSTRACT

An apparatus for use during drilling of a wellbore. The apparatus includes a receiving device that receives cuttings from a separator and a sensor for providing information relating to weight of the cuttings received by the receiving device for determining the weight of the cuttings received. A method is provided for determining an amount of cuttings received in a fluid from a wellbore by separating the cuttings from the fluid, receiving the separated cuttings on a member, and determining weight of the cuttings received using a sensor associated with the receiving device.

19 Claims, 4 Drawing Sheets

APPARATUS AND METHOD FOR SEPARATING AND WEIGHING CUTTINGS RECEIVED FROM A WELLBORE WHILE DRILLING

BACKGROUND OF THE DISCLOSURE

1. Field of the Disclosure

The present disclosure relates to drilling systems that include a system for separating cuttings at a well site.

2. Description of the Related Art

Wellbores or wells for recovery of hydrocarbons (oil and gas) are drilled using a drill string that includes a tubular conveyed from a surface location into the wellbore. The drill string includes a drilling assembly (also referred to as a bottomhole assembly or "BHA") at the bottom end of the tubular that includes a variety of tools and devices and a drill bit. The drill bit is rotated by rotating the drill string and/or a motor in the drilling assembly to disintegrate rocks. A drilling fluid, commonly referred to as the "mud" is supplied under pressure from the surface to the drill string. The drilling fluid discharges at the bottom of the drill bit and returns to the surface via a spacing between the wellbore and drill string, referred to as the "annulus." The returning fluid carries the disintegrated rocks (referred to as the "cuttings") to the surface. The cuttings are separated from the returning drilling fluid and are typically either dumped into vessels, which are transported from the well site or dumped onto seabed with no weight or volumetric measurements. The weight of the cuttings is typically determined by weighing the vessels and the volume of the cuttings is determined from the volume of the vessels occupied by the cuttings. The weight and volume provides information relating to quality of the wellbore being drilled and certain characteristics of the rock formation drilled, such as density and the composition of the formation.

Such systems and methods are not efficient and can take substantial time from the time the cuttings are separated and weighed. The disclosure herein provides apparatus and methods for determining the weight of the cuttings as they are separated.

SUMMARY

In one aspect, an apparatus for use during drilling of a wellbore is provided, that in one embodiment may include: a separator for separating cuttings from fluid received from a wellbore; a receiving device that receives cuttings from the separator; a sensor for providing information relating to weight of the cuttings received by the receiving device; and a controller for determining the weight of the cuttings received by the receiving device. In another aspect, the receiving device includes a rolling member that receives the cutting from the separator.

In another aspect, a method of determining amount of cuttings received in a fluid from a wellbore is disclosed that in one embodiment may include: receiving cuttings separated from the fluid; receiving the separated cuttings on a moving member; and determining weight of the cuttings received by the moving member using a sensor associated with the receiving device.

Examples of certain features of the apparatus and method disclosed herein are summarized rather broadly in order that the detailed description thereof that follows may be better understood. There are, of course, additional features of the apparatus and method disclosed hereinafter that will form the subject of the claims.

BRIEF DESCRIPTION OF THE DRAWINGS

For detailed understanding of the present disclosure, references should be made to the following detailed description of the exemplary embodiment, taken in conjunction with the accompanying drawings, in which like elements have been given like numerals and wherein.

DETAILED DESCRIPTION OF THE DISCLOSURE

Figure 1:
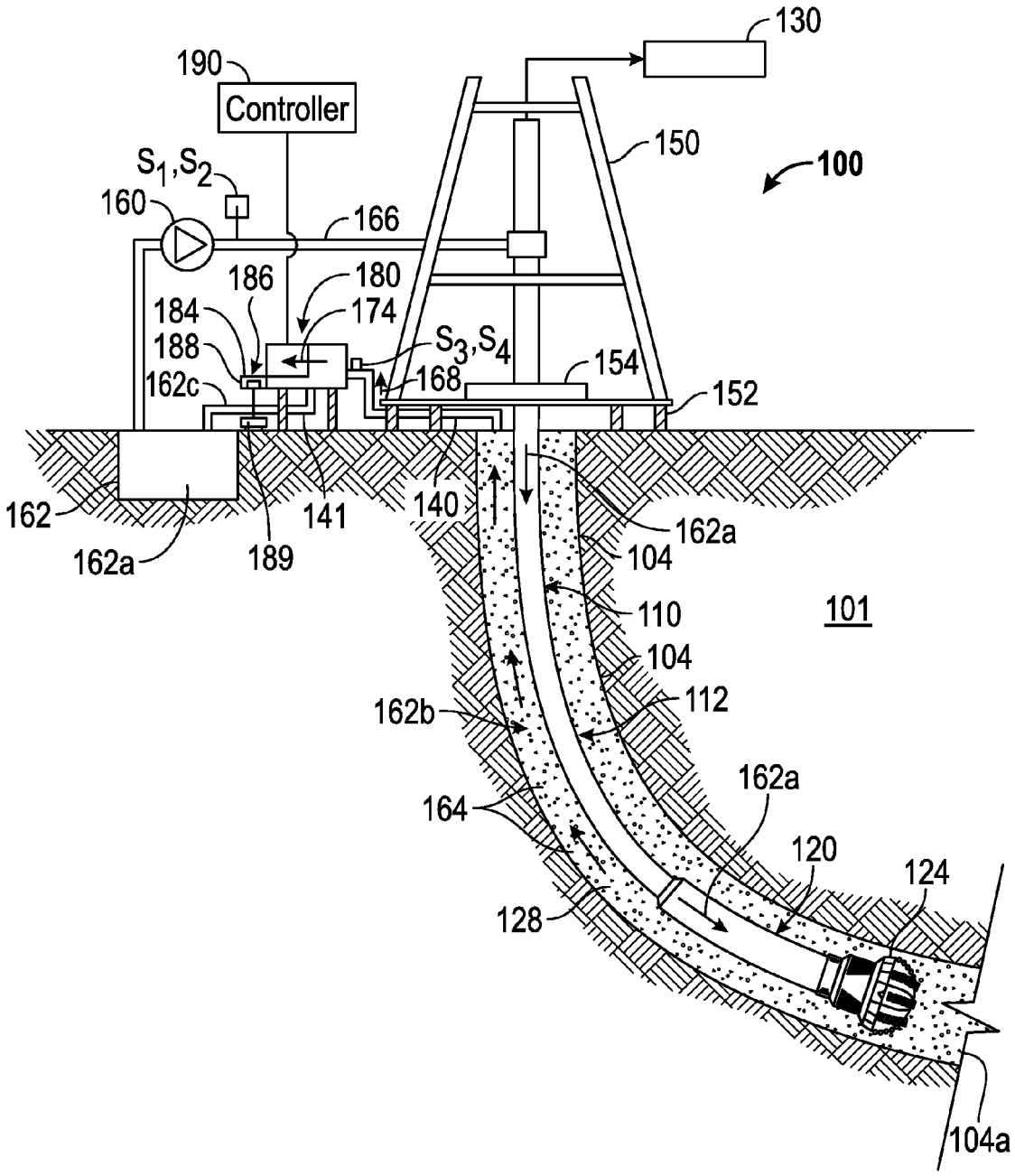
FIG. 1 is a schematic diagram of an exemplary drilling system that includes a drill string having a drilling assembly attached to its bottom end that includes a steering unit according to one embodiment of the disclosure.

FIG. 1 shows an exemplary drilling system 100 that includes a drill string 110 that comprises a drilling assembly or bottomhole assembly (BHA) 120 attached to a bottom end of a drilling tubular 112 (such as a drill pipe). A drill bit 124 attached to the bottom of the drilling assembly is used to drill a wellbore 104 in a formation 101. The drilling system 100 is further shown to include a conventional derrick 150 erected on a platform 152 that supports a rotary table 154 rotated by a prime mover, such as an electric motor or a top drive (not shown). The rotary table 154 or the top drive connected to the tubular 112 rotates the drilling tubular 112 at a desired rotational speed to drill the wellbore 104. The drilling tubular 112 typically includes jointed metallic pipe sections and extends downward from the rotary table 152 into the wellbore 104. The drill bit 124 attached to the end of the drilling assembly 120 disintegrates the geological formations to form the wellbore 104. The drill string 110 is coupled to a drawworks 130 that controls the weight on bit (WOB), which affects the rate of penetration.

During drilling operations, a mud pump 160 supplies, via a line 166, a suitable drilling fluid or mud 162*a* under pressure from a source or mud pit 162 to the drill string 110. The drilling fluid 162*a* discharges at the wellbore bottom 104*a* through openings in the drill bit 124. The drilling fluid 162*a* discharged at the bottom 104*a* collects cuttings 164 resulting from disintegration of the formation. The mixture 162*b* of drilling fluid 162*a* and cuttings 164 returns to the surface via an annular space 128 between the drill string 110 and the wellbore 104 and a return line 140. Sensors $S_1$ and $S_2$ associated with or in the line 166 provide information about the flow rate and pressure, respectively, of the fluid being supplied to the drill string 110. Sensors $S_3$ and $S_4$ associated with or in return line 140 provide information about the flow rate and pressure, respectively, of the returning mixture 162*b*.

Still referring to FIG. 1, the returning mixture 162*b* is discharged into a separator 180 that separates the mixture 162*b* into cuttings 174 a fluid 162*c*. The fluid 162*c*, in one aspect, may be discharged into the mud pit 162 via a line 141 or processed and then discharged into the mud pit 162. In one aspect, the cuttings 174 separated by the separator 180 may be discharged onto a moving member 184 of a receiving unit 186. Sensors 188 associated with the receiving unit 186 provide signals relating to the weight of the cuttings 174 on the moving member 184. The cuttings 174 from the moving member 184 may be discharged into vessels 189 and transported for further disposal. A controller, such as a computer-based system 190 may be utilized to process the signals from the sensors 188 to determine the weight of the cuttings 174 being received on the moving member while drilling. The volume of the cuttings 174 being received may be determined from the weight and estimated density of the cuttings 174 or from the volume of the vessels 189.

Figure 2:
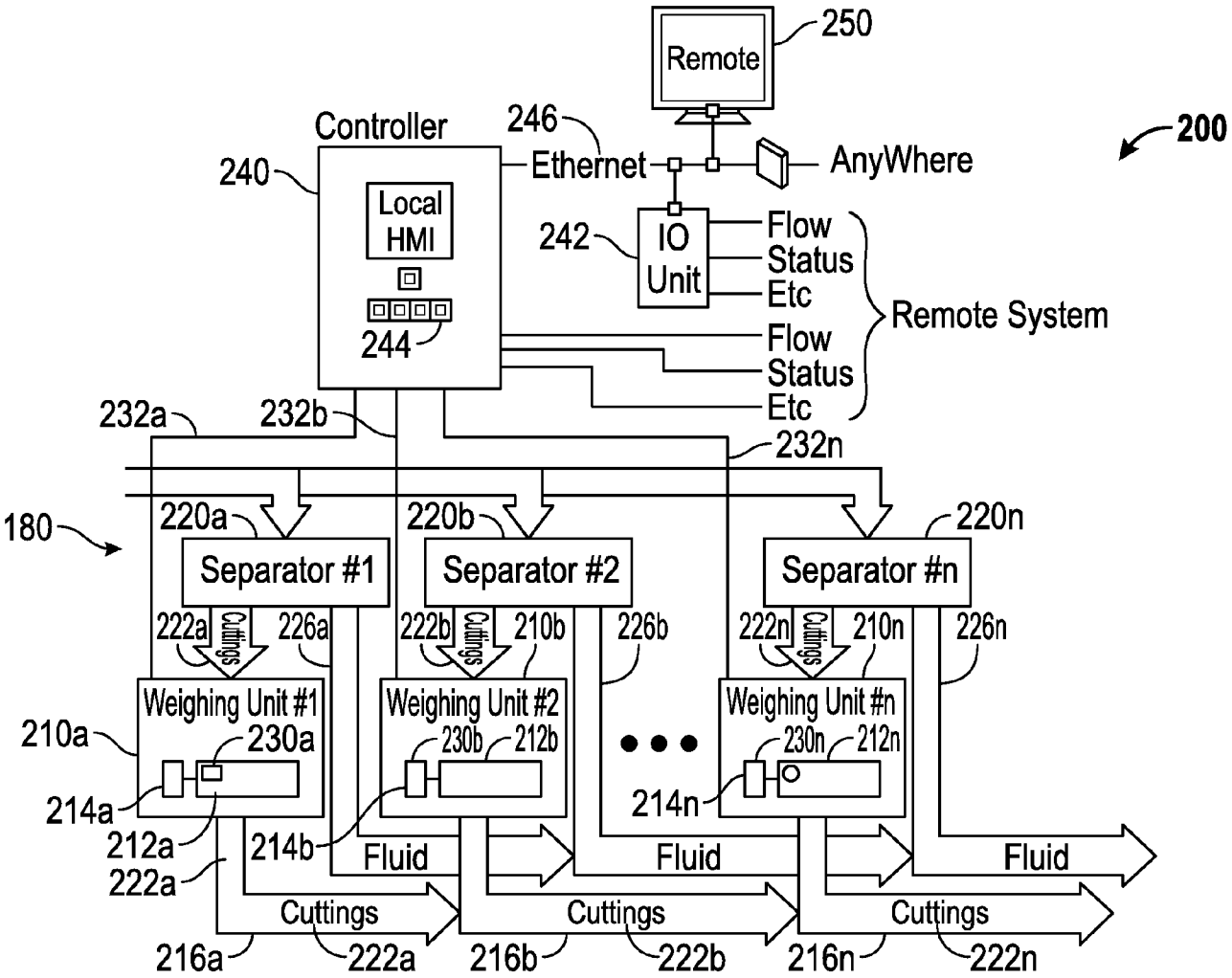
FIG. 2 shows a system for determining weight and volume of cuttings received from a wellbore during drilling of such wellbore, according to one embodiment of the disclosure.

FIG. 2 shows a system 200 for determining weight and volume of cuttings received from a wellbore during drilling of such wellbore, according to one embodiment of the disclosure. The system 200 shows a number of cutting weighing units 210*a*, 210*b* through 210*n*. Each such weighing unit is shown to include a movable member and one or more load cells. In the particular embodiment of system 200 shown, weighing unit 210*a* includes a movable member 212*a* and one or more load cells 214*a*, weighing unit 210*b* includes a movable member 212*b* and load cells 214*b* and weighing unit 210*n* includes a movable member 212*n* and load cells 214*n*. The movable member may be any suitable member that is configured to receive the cuttings thereon and discharge such received cuttings into a vessel. In an aspect, the movable member may be a belt disposed on rollers, where the belt has a flat surface for receiving the cuttings and a motor that rotates or rolls the belt around the rollers. The system 200 is shown to include cutting separators 220*a*, 220*b* through 220*n*, wherein separator 220*a* discharges cuttings 222*a* onto the movable member 212*a* of weighing unit 210*a*, separator 220*b* discharges cuttings 222*b* on movable member 212*b* of weighing unit 210*b* and separator 220*n* discharges cuttings 222*n* onto the movable member 212*n* of weighing unit 210*n*. The drilling fluid separated by separators 220*a*, 220*b* through 220*n* is supplied to the drilling fluid source via fluid lines 226*a*, 226*b* through 226*n* respectively. As the cuttings from a separator are discharged onto the movable member of a weighing unit, its associated load cells provide continuous signals corresponding to the weight on the movable member, while the movable member is moved at a selected speed. In the system 200, a motor 230*a* drives a mechanism to roll the movable member drives, motor 230*b* rolls movable member 212*b* and motor 230*n* rolls movable member 212*n*. The cuttings 222*a* from the movable member 212*a*, cuttings 222*b* from movable member 212*b* and cuttings 222*n* from movable member 212*n* are discharged into vessels (not shown) via conveying members 216*a*, 216*b* through 216*n*, respectively, for further processing. A controller or control unit 240 receives signals from each of the load sensors 214*a*, 214*b* through 214*n* via communication lines 232*a*, 232*b* through 232*n*, respectively, processes such signals using the speed of the moving members, algorithms and instructions provided to the controller 240 and determines the weight of the cuttings on each movable member. The controller also may determine the volume of the cuttings received by each weighing unit from the determined weight and the density of the cuttings.

In one aspect, the controller 240 is a computer-based system that has an associated input/output unit 242 for use by field personnel to input instructions to the controller 240. The controller may include desired visual indicators (such as lights and alarms relating to various operations of the system 200) collectively denoted by numeral 244. The information from the controller 240 may be communicated via a communication link (wired, optical, wireless, etc.) to a remote unit 250 for operators to exchange information with the controller 240 and/or provide instructions thereto.

Figure 3:
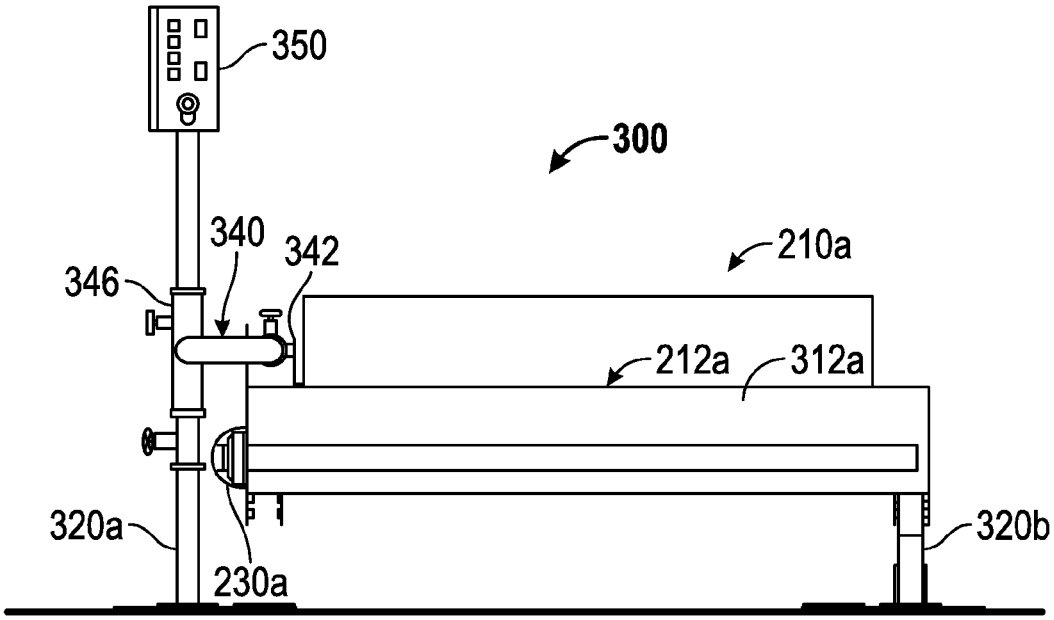
FIG. 3 shows a front view of a weighing unit shown in FIG. 2.
Figure 4:
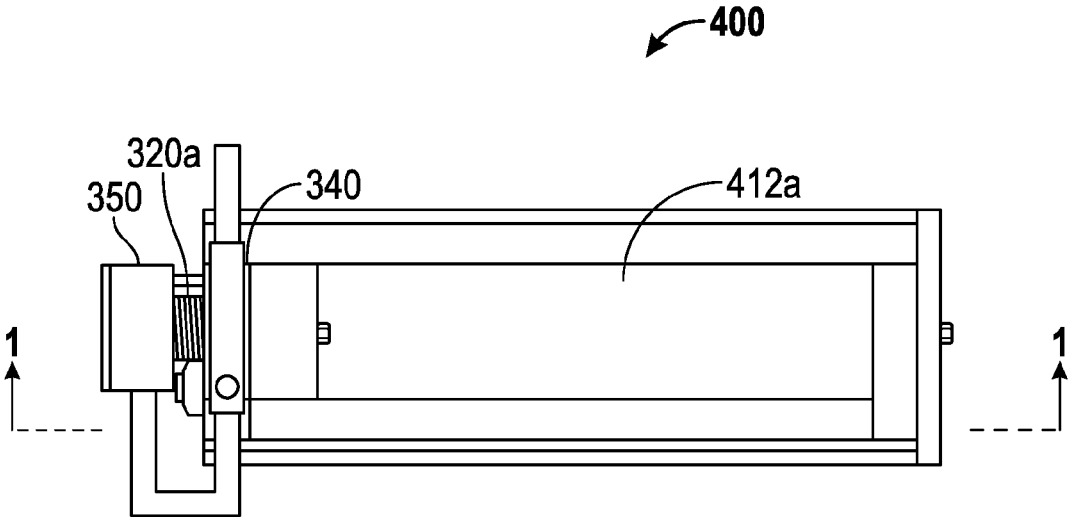
FIG. 4 shows a top view of the weighing unit shown in FIG. 2.

FIG. 3 shows a front view 300 of a weighing unit, such as unit 210*a*, and FIG. 4 shows a top view 400 of the weighing unit 210*a*. Referring now to FIGS. 3 and 4, the movable member 212*a* may be mounted on adjustable mounting members 320*a* and 320*b*, such as adjustable columns. Cuttings from a separator are received on the top flat portion 412*a*. The variable speed motor 230*a* rotates the movable member 212*a*, which causes the cuttings received on the top surface 412*a* to roll off the side 312*a* of the movable member 212*a*. In an aspect, a suitable translational and rotational positioning and locking mechanism 340 may be provided to position and lock the movable member below the separator. The vertical position of the movable member may be adjusted and locked by a position locking device 346. When the movable member 212*a* is unlocked from the positioning and locking mechanism 340, a tilt and secure device or structure 342 allows an operator to tilt the movable member 212*a*, thereby providing access to performing maintenance on various components associated with the movable member 212*a*. A junction box 350 that includes an electrical junction box and selected control buttons for the operator to control various functions of the weighing unit 210*a* may be provided at any suitable location, including a suitable location on the mounting member 320*a*.

Figure 5:
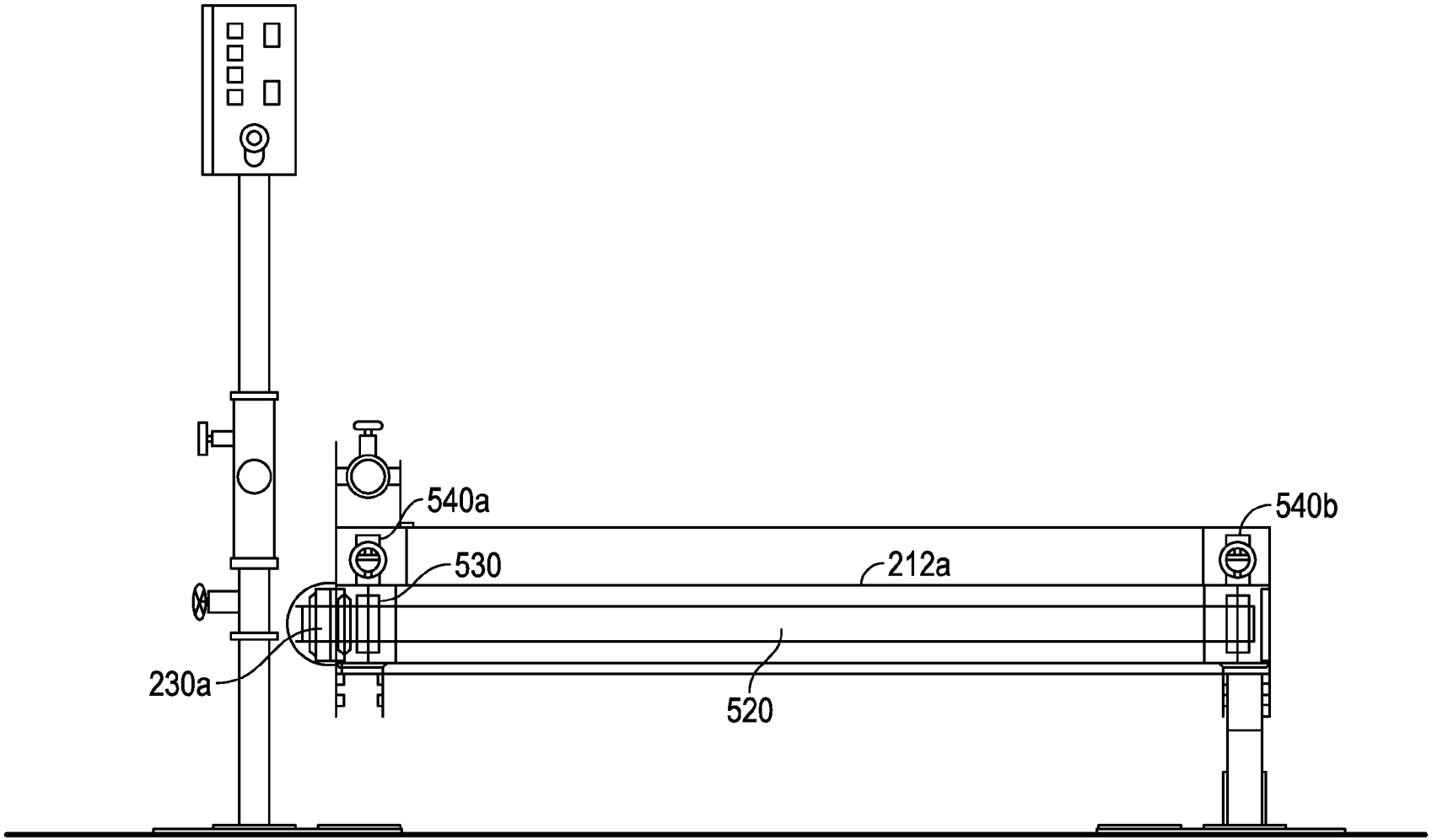
FIG. 5 shows a cross-section of the movable member taken along line B shown in FIG. 4.

FIG. 5 shows a cross-section of the movable member 212*a* taken along line 1 shown in FIG. 4. In the particular configuration of FIG. 5, the motor 230*a* rotates drive pulley 520 about bearings 530, which causes the belt to roll about the pulley. One or more load cells, such as load cells 540*a*, 540*b*, etc. may be provided at suitable locations to provide information about the weight on the movable member 212*a*.

Thus, in the particular embodiment of system 200 (FIG. 2) cuttings received from a wellbore and separated by a separator at the well site are discharged onto a member moving at a selected speed. One or more sensors provide information about the weight on the moving member. A controller at the well site/and or at a remote location using the measurements from the sensors determines the weight of the cuttings received by the moving member in real time during drilling of the wellbore. Volume of the cuttings may be determined from the determined weight and estimated density of the received cuttings. Such information may be utilized to determine the quality of the well being drilled and certain characteristics of the formation being drilled.

While the foregoing disclosure is directed to the preferred embodiments of the disclosure, various modifications will be apparent to those skilled in the art. It is intended that all variations within the scope and spirit of the appended claims be embraced by the foregoing disclosure.

The invention claimed is:

1. An apparatus for use during drilling of a wellbore, comprising:

a receiving device including a movable member having a first longitudinal side and a second longitudinal side opposite the first longitudinal side, wherein the movable member continuously receives cuttings from a separator along a length of the first longitudinal side and discharges the cuttings along a length of the second longitudinal side;

a sensor for providing information relating to weight of the cuttings received by the movable member while the movable member is moving; and a motor mounted at a side of the movable member adjacent the first longitudinal side and that moves the movable member to discharge the cuttings at the second longitudinal side.

2. The apparatus of claim 1, further comprising a controller for continuously determining the weight of the cuttings using information provided by the sensor.

3. The apparatus of claim 2, wherein the controller controls speed of the movable member in response to the determined weight of the cuttings.

4. The apparatus of claim 3, wherein the controller determines volume of the cuttings received by the movable member from the determined weight.

5. The apparatus of claim 1, wherein the movable member receives the cuttings substantially continuously from the separator.

6. The apparatus of claim 1, further comprising a position mounting device that locks the movable member at a selected position on a mounting member on fall the side of the movable member adjacent the first longitudinal side.

7. The apparatus of claim 1, wherein the movable member is placed below an outlet of the separator to receive the cuttings directly from the separator and discharges the received cuttings to a transport associated with the separator by a transitional locking and rotational unit.

8. The apparatus of claim 1 further comprising a tilt device that tilts the movable member when the movable member is unlocked from a locked position to allow access to components of the receiving unit.

9. A drilling system for drilling a wellbore from a surface location, comprising:

a drill string that drills a wellbore using circulating fluid in the wellbore that returns rock cuttings therewith to the surface location;

a separator that separates the rock cuttings from the circulating fluid at the surface location;

a receiving device that includes a movable member having a first longitudinal side and a second longitudinal side opposite the first longitudinal side, wherein the movable member continuously receives cuttings from the separator along a length of the first longitudinal side and discharges the cuttings along a length of the second longitudinal side;

a sensor for providing information relating to weight of the cuttings received by the receiving device while the movable member is moving;

a controller for determining the weight of the cuttings received by the receiving device; and a motor mounted at a side of the movable member adjacent the first longitudinal side and that moves the movable member to discharge the cuttings from the movable member at the second longitudinal side.

10. The drilling system of claim 9, wherein the motor rolls the movable member about roller members.

11. The system of claim 10, wherein the movable member is configured to tilt when the movable member is unlocked from a locked position.

12. The drilling system of claim 9, wherein the controller determines the weight and volume of the rock cuttings substantially as the receiving member receives the rock cuttings.

13. A method of determining an amount of cuttings received in a fluid from a wellbore, the method comprising:

separating the cuttings from the fluid;

continuously receiving the separated cuttings on a moving member of a receiving device along a length of a first longitudinal side of the moving member as the cuttings are being separated;

using a motor mounted at a side of the movable member adjacent the first longitudinal side to move the movable member to a second longitudinal side opposite the first longitudinal side;

obtaining measurements of weight of the cuttings received by the moving member while the movable member is moving;

determining weight of the cuttings received by the moving member from the measurements of the weight; and discharging the cuttings from the moving member at the second longitudinal side of the moving member.

14. The method of claim 13, further comprising controlling speed of the moving member in response to the determined weight of the cuttings.

15. The method of claim 13, wherein determining the weight of the cuttings received by the moving member comprises using a controller to determine the weight of the cuttings using the measurements of the weight of the cuttings and speed of the moving member.

16. The method of claim 13, further comprising rolling the moving member about rollers at a selected speed.

17. The method of claim 13, wherein receiving the separated cuttings on the moving member as the cuttings are being separated comprises receiving the separated cuttings directly onto the moving member.

18. The method of claim 13, further comprising determining volume of the cuttings received by the receiving member from the determined weight of the cuttings.

19. The method of claim 13 further comprising providing a tilt device that tilts the moving member when the moving member is unlocked from a locked position to allow access to components of the receiving device.

* * * * *